US008627940B2

(12) United States Patent
Lanzki et al.

(10) Patent No.: US 8,627,940 B2
(45) Date of Patent: Jan. 14, 2014

(54) DRIVE SYSTEM FOR A PASSENGER TRANSPORT INSTALLATION

(75) Inventors: Winfried Lanzki, Unna (DE); Andreas Tautz, Waltrop (DE); Carsten Rolf, Sprockhoevel (DE); Heinrich Zeiger, Muenster (DE); Alfred Thiel, Lauda-Koenigshofen (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/355,759

(22) Filed: Jan. 23, 2012

(65) Prior Publication Data

US 2012/0181143 A1 Jul. 19, 2012

Related U.S. Application Data

(63) Continuation of application No. PCT/DE2010/000841, filed on Jul. 21, 2010.

(30) Foreign Application Priority Data

Jul. 23, 2009 (DE) ..... 10 2009 034 346

(51) Int. Cl.
*B66B 23/02* (2006.01)

(52) U.S. Cl.
USPC ..... 198/330; 198/331

(58) Field of Classification Search
None
See application file for complete search history.

(56) References Cited

U.S. PATENT DOCUMENTS

| | | | | |
|---|---|---|---|---|
| 3,658,166 | A | 4/1972 | Hara et al. | |
| 5,819,910 | A * | 10/1998 | Langer et al. | 198/834 |
| 7,296,671 | B2 * | 11/2007 | Pietz | 198/330 |

FOREIGN PATENT DOCUMENTS

| | | |
|---|---|---|
| BE | 563031 A | 6/1960 |
| DE | 2421729 | 11/1975 |
| DE | 2541397 | 3/1977 |
| DE | 3526905 A1 | 2/1987 |
| WO | WO-2010/115410 | 10/2010 |

OTHER PUBLICATIONS

International Search Report of PCT/DE2010/000841 Dated Dec. 7, 2010 With an English Translation.

* cited by examiner

*Primary Examiner* — Kavel Singh
(74) *Attorney, Agent, or Firm* — Venable LLP; Robert Kinberg; Tamatane J. Aga

(57) ABSTRACT

A drive system for transport of a passenger transport installation including an escalator or a moving walkway. Steps or pallets of the transport are actively connected to pulling elements which can be moved in the transport direction by at least one electric motor provided with a gear train having a chain wheel. The electric motor containing the gear train is positioned in one of the reversing areas of the transport and a further electric motor exclusively serves for the linear motion of the transport. Bushes/rolls of plate link chains are adjacent to or roll along individual teeth of the chain wheel while only getting into line contact, outside the tooth ground of the chain wheel. A point of force application of the bushes/rolls on the respective tooth of the chain wheel is realized such that only a one-directional force application component is generated at the respective tooth.

8 Claims, 6 Drawing Sheets

DRIVE SYSTEM FOR A PASSENGER TRANSPORT INSTALLATION

CROSS-REFERENCE TO RELATED APPLICATIONS

This application is a continuation of International Application No. PCT/DE2010/000841, designating the United States and claiming priority to German application No. DE 10 2009 034 346.6 filed Jul. 23, 2009, the disclosures of both foregoing applications being incorporated herein by reference in their entireties.

BACKGROUND OF THE INVENTION

The invention relates to a drive system for transport of a passenger transport installation, in particular an escalator or a moving walkway, wherein the transport, in particular steps or pallets, are actively connected to pulling elements and the pulling elements can be moved in the transport direction by at least one electric motor provided with a gear train.

DE 25 41 397 discloses a drive unit arranged within a revolving step belt of escalators and composed of an electric motor, a gear and a handrail drive, wherein the drive shaft of the gear simultaneously serves as main drive shaft of the step belt.

DE 35 26 905 C2 discloses a drive for escalators and moving walkways in a reversing area, which drive is arranged within the revolving step or pallet belt, and comprise an electric motor, gears, a step or pallet drive and a handrail drive, and also being arranged between the step or pallet drive shaft and the handrail drive shaft, wherein the exit gearwheel of the gear is provided in direct engagement with the step or pallet drive shaft gearwheel. At least one electric motor having a planet gear is provided as a center axis equivalent drive unit, axis parallel to the step or pallet drive shaft and the handrail drive shaft.

DE 24 21 729 C3 discloses a drive for excessively long escalators and moving walkways, comprising drive motors arranged in pairs, transmission gears, a main drive shaft, a clamping shaft and cardan shafts serving for the drive of the handrails.

BE 563031 discloses a generic drive system for a transport of a passenger transport installation, in particular an escalator or a moving walkway.

U.S. Pat. No. 3,658,166 A describes a passenger transport installation, in particular a drive system for a passenger transport installation which comprises a constructively similar structure as BE 563031 A. Herein, the intermediate drive gearwheel has involute-shaped tooth flanks.

Finally, U.S. Pat. No. 5,819,910 discloses a chain starwheel having a modular structure which is provided for the silent reversing of plate link chains. Damping elements are at least mounted on the front of the chain starwheel.

SUMMARY OF THE INVENTION

It is an object of the invention to provide a drive system for excessively long escalators of any geometric shape, which has a simple structure and does not require any over-dimensioned drives.

The above and other objects are achieved according to the invention in that the electric motor containing the gear train is positioned in one of the reversing areas of the transport means and the further electric motor exclusively serves for the linear motion of the transport means, in such a way that bushes, respectively rolls of the plate link chains are adjacent to or roll along individual teeth of the chain wheel while only getting into line contact, outside the tooth ground of the chain wheel, and that the point of force application of the cylinder bushes/rolls on the respective tooth of the chain wheel is realized such that only a one-directional force application component is generated at the respective tooth.

According to another aspect of the invention, the gear train arranged in the reversing area is provided with chain starwheels which engage with the respective pulling elements formed as plate link chains and reverse the plate link chains including the transport fastened thereto in the associated reversing area, wherein each further gear train interacts with chain wheels, the teeth of which engage with the plate link chain and drive the same one in an exclusively linear direction.

In one embodiment the bushes of the plate link chains are adjacent to or roll along individual teeth of the chain wheel while only getting into line contact, outside the tooth ground of the respective chain wheel.

According to another aspect of the invention, the chain wheel interacts with a ring-shaped shoulder in the region of its teeth, which shoulder serves as supporting body for single plates of the plate link chain. This measure assures that the cylinder bushes/rolls of the plate link chain do not contact the tooth ground, but rather get adjacent to the teeth of the chain wheel always at the same spot for generating an only one-directional force component.

In another embodiment, the entire drive for the passenger transport installation composed of electric motor, gear train and chain wheels is advantageously positioned between the plate link chains connected to the transport means.

BRIEF DESCRIPTION OF THE DRAWINGS

The subject of invention is represented in the drawing by means of an exemplary embodiment and described as follows. Herein.

DETAILED DESCRIPTION OF THE INVENTION

Figure 1:
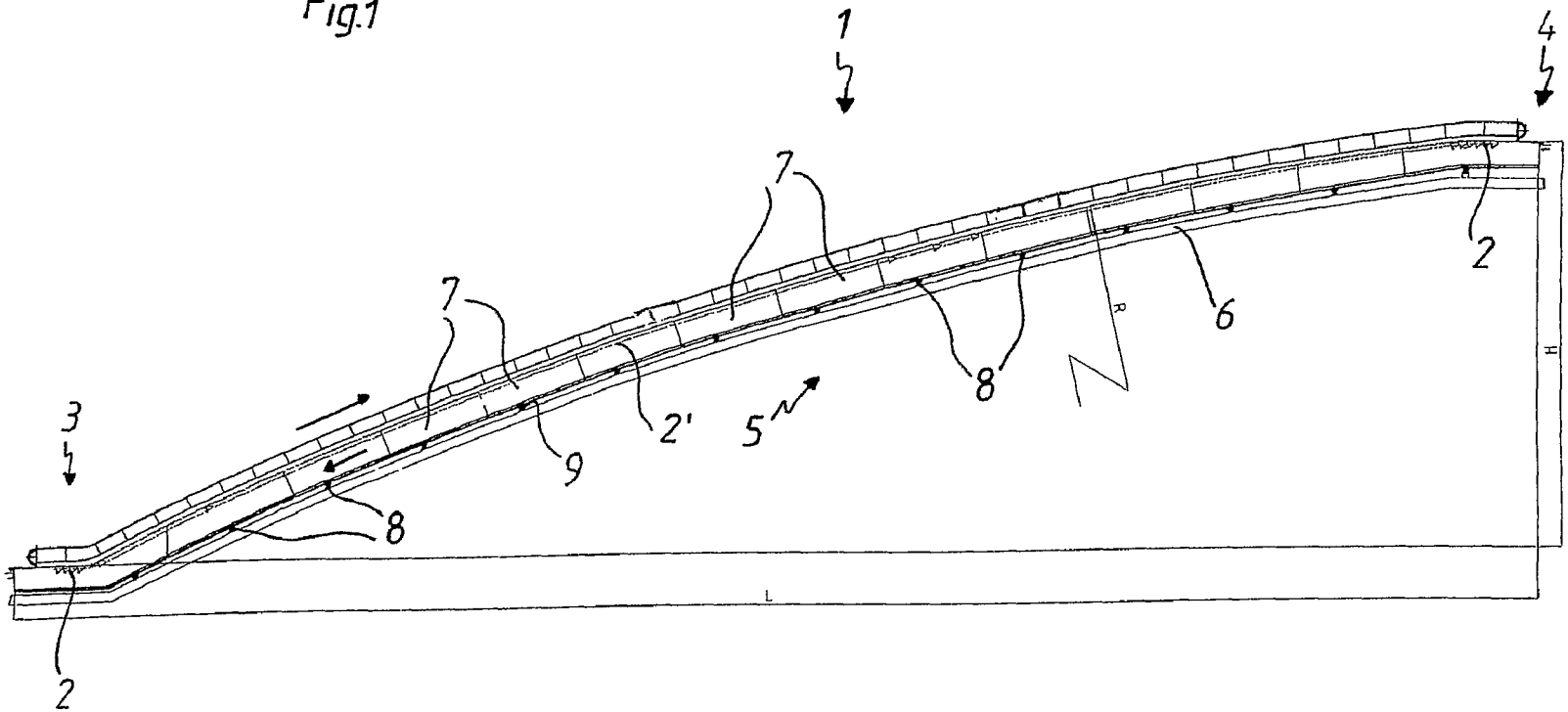
FIG. 1 is a schematic diagram of a device for the passenger transport.
Figure 2:
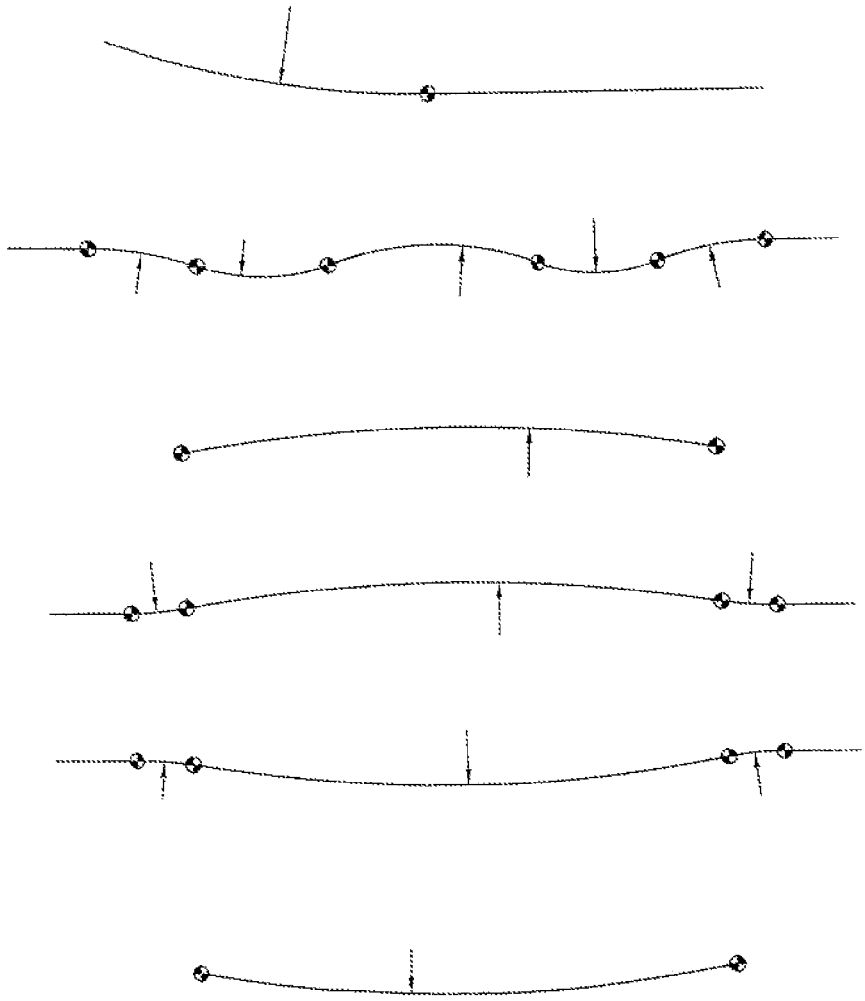
FIG. 2 shows linear guidances of transport sections of a moving walkway.

FIG. 1 is a schematic diagram which shows a device for the passenger transport 1 which is an escalator in this example. The passenger transport device can also be a moving walkway in so far as the legally prescribed angles of inclination are observed. A step belt 2' composed of a plurality of steps 2 (transport) is only outlined. The different directions of movement (upwards, downwards) are outlined by means of arrows. A non-illustrated drive for the step belt 2' can be positioned in the entrance section 3 and/or exit section 4. In this example, the left lower part of FIG. 1 shall represent an entrance section 3 and the right upper part of FIG. 1 shall represent an exit section 4. A transport section 5 which is formed as a spatial curve arc in this example extends between the lower entrance section 3 and the upper exit section 4. An excessively long and linear escalator or moving walkway which extends with a pre-determinable angle of inclination between the entrance section 3 and the exit section 4 is also conceivable. In this example, a curve arc shall be present, which comprises a pre-determinable radius R of for example 210 m. In this example, an arched substructure 6 which receives the transport section 5 is provided on the side of the building. As already stated, on certain conditions the transport section 5 can also be designed as a cantilever type. The transport section 5 itself is formed by a plurality of linear framing sections 7. Each framing section 7 can have bearings 8, by which it can be supported in an adjustable manner on the surface 9 of the substructure 6. As represented in FIG. 2, the respective framing section can also be curved or designed in any shape.

FIG. 2 shows, in the form of lines, some technically realizable options to connect entrance or exit sections of a moving walkway to transport sections. In the case of moving walkways it has to be taken care that the legally prescribed angles of inclination are observed.

Figure 3:
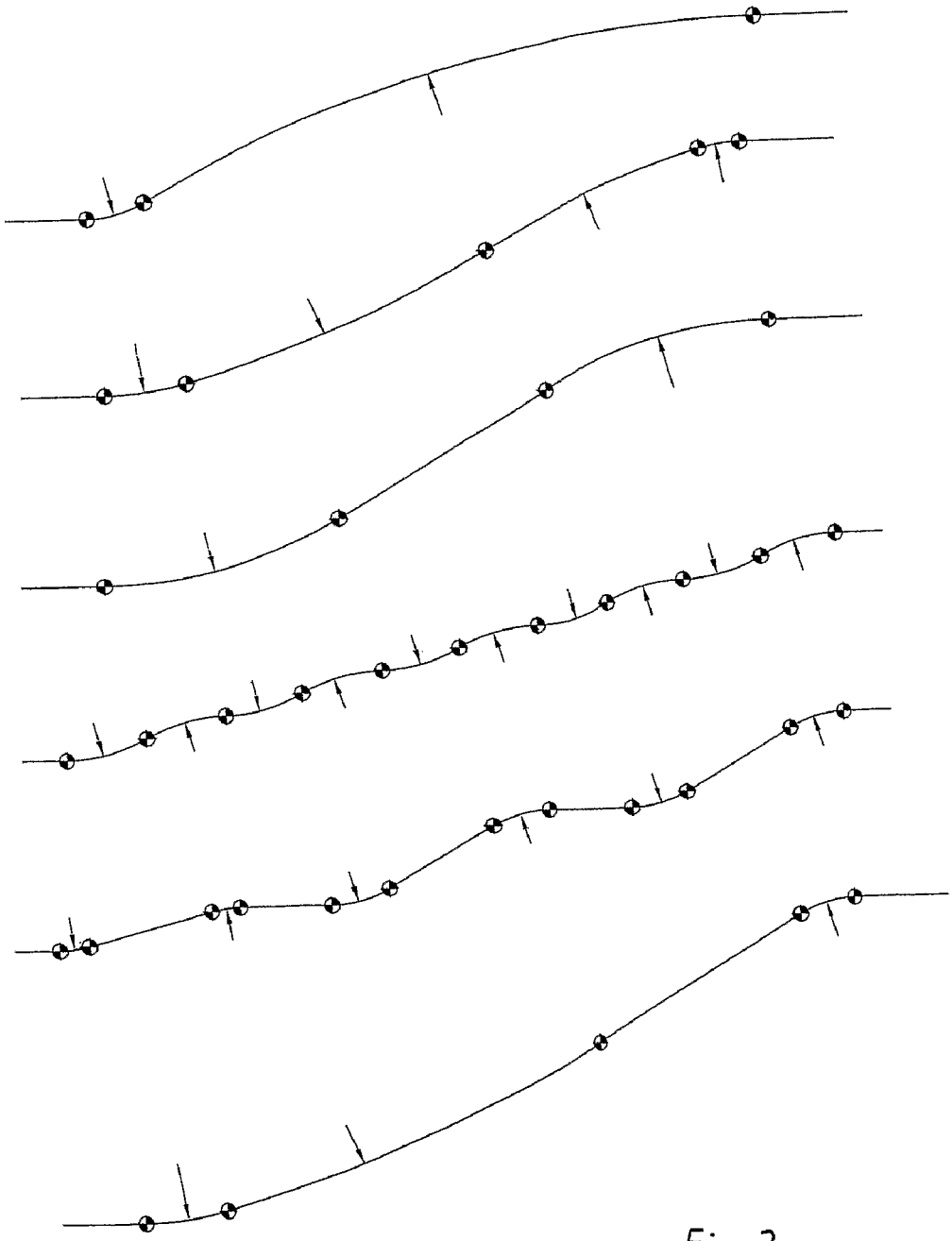
FIG. 3 shows linear guidances of transport sections of an escalator.

FIG. 3 shows, in the form of lines, some technically realizable options to connect entrance or exit sections of an escalator to transport sections. Different convex and concave curve sections are used. The different radii are represented by arrows. As already explained, the radii can have different sizes. If required, curve-like transport sections can be combined with linear transport sections.

Figure 4:
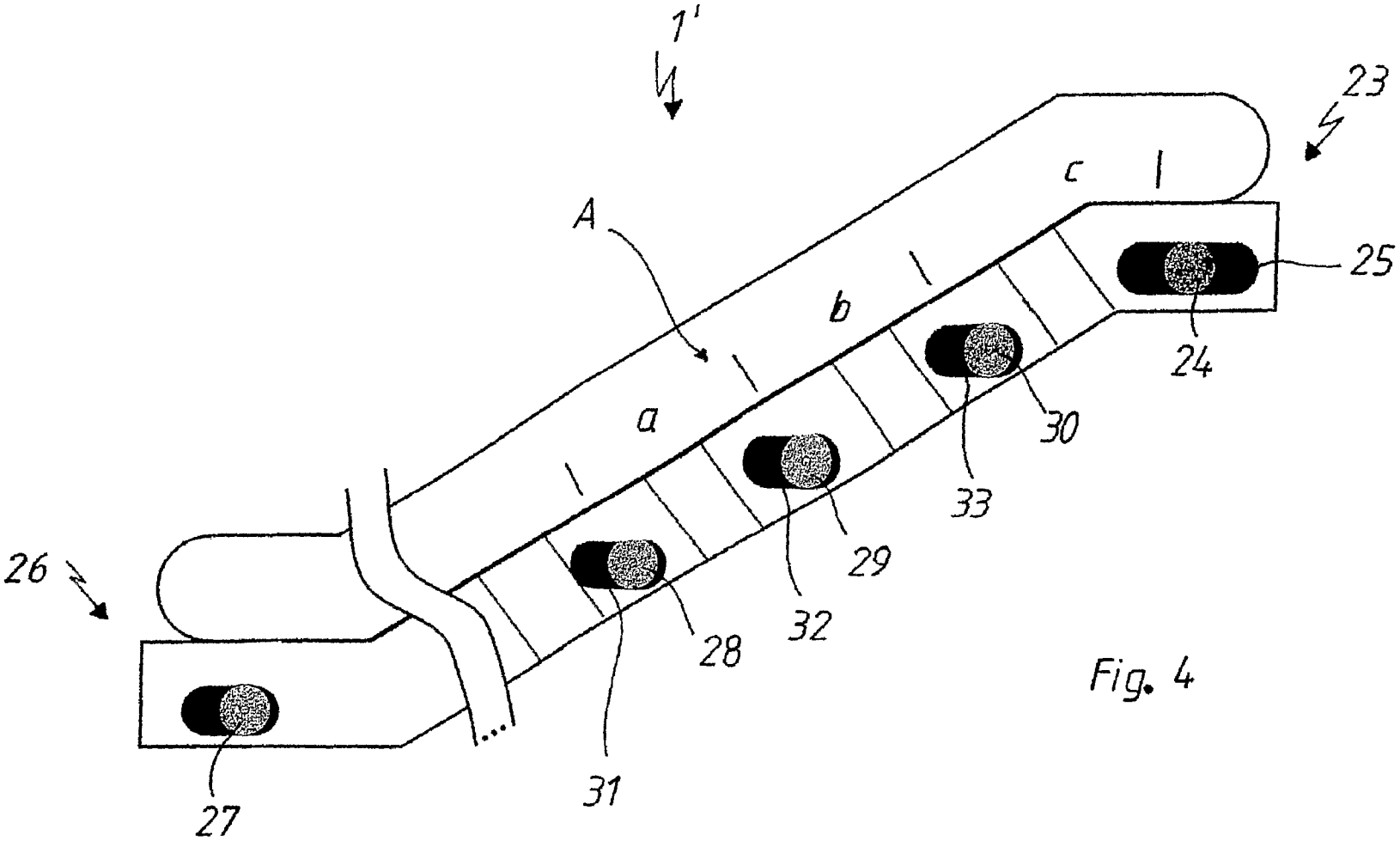
FIG. 4 is a partial representation of the drive system according to the invention.

FIG. 4 is a schematic diagram which shows a conventional device for the passenger transport 1', which is formed by an excessively long escalator in this example. All the components which are represented here can also be transferred to a passenger transport installation 1 according to FIG. 1. In the example according to FIG. 4, a first electric motor 24 including an outlined reducing gear 25 is positioned in the upper reversing area 23 of the device 1'. Herein, the constructional structure of the drive 24/25 can be analogous to that disclosed in DE 25 41 397.

In the lower area 26 of the device 1', an additional handrail drive 27 is provided in this example.

The device 1' can be used for covering any transport heights and/or transport distances, in that a further electric motor 28, 29, 30 including reducing gears 31, 32, 33 may be positioned between the here non-illustrated plate link chains which form an additional transport. This arrangement permits realization of an extremely space-saving construction. Not shown here is that the electric motor 24 respectively the reducing gear 25 provided in the area 23 interacts with two reversing elements which are formed by chain starwheels and which reverse the moving direction of the plate link chains including the transport. All the electric motors 24, 28, 29, 30 and reducing gears 25, 31-33 are dimensioned to have approximately the same power, wherein each electric motor 24, 28, 29, 30 is used for the motion of the transport over a defined section a, b, c of the transport path A.

The other electric motors 28 through 30 respectively the associated reducing gears 31 through 33 interact with non-illustrated chain wheels which are in engagement with the plate link chains comprising cylinder bushes or rolls and which are exclusively responsible of the linear motion of the transport respectively the plate link chains.

Figure 5:
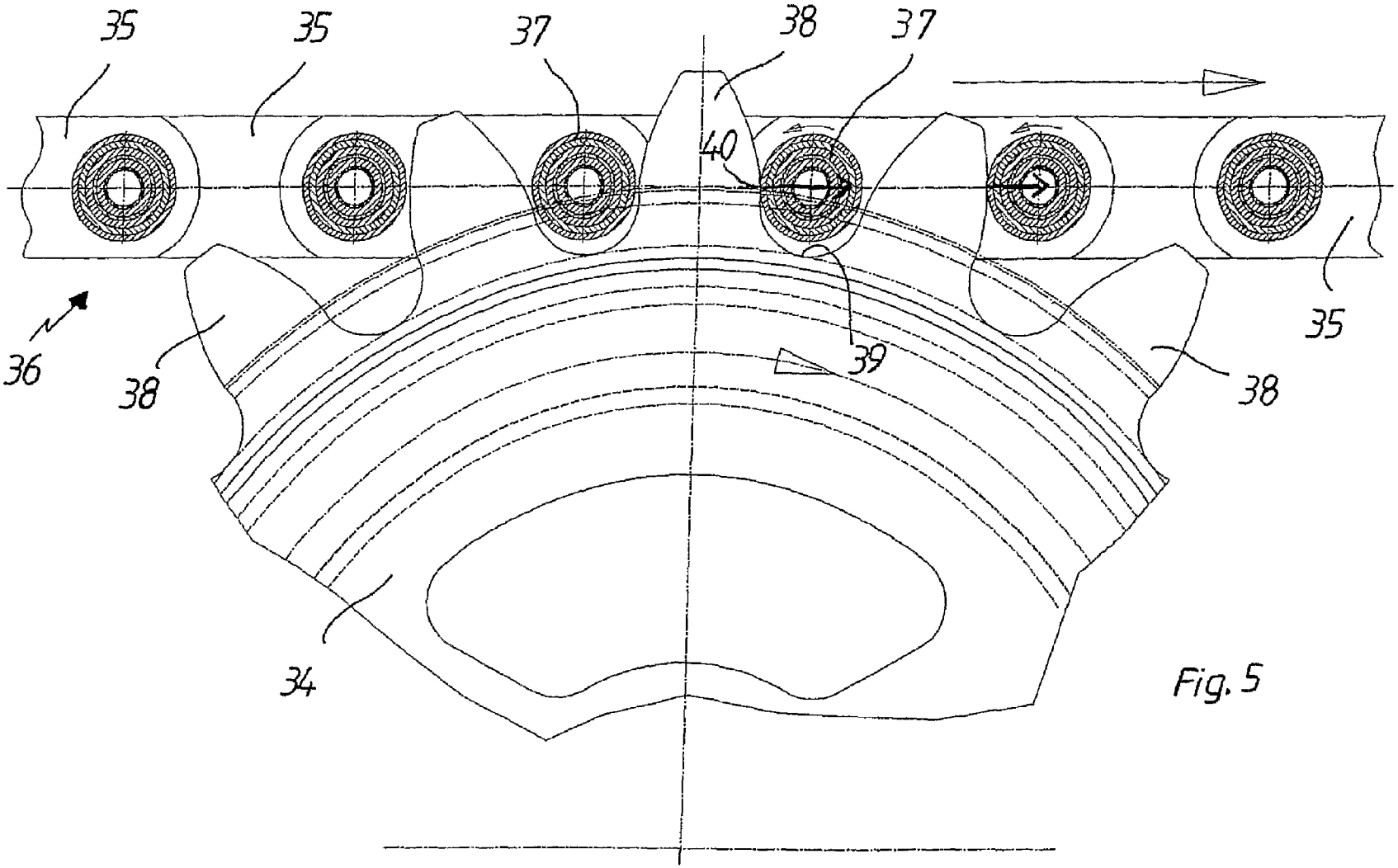
FIG. 5 is a schematic diagram of the guidance of the pulling element in the area of the chain wheel.

FIG. 5 is a partial representation of one of the chain wheels 34 which interact with the other reducing gears 31, 32, 33 in the area of the transport path A. The plate link chain is formed by a plurality of plates 35. Cylinder bushes 37/rolls, by which the plates 35 can be moved with respect to each other, are positioned in the end regions of the plates 35. The direction of motion of the chain wheel 34 is represented by an arrow. The plate link chain 36 is exclusively moved in a linear direction (arrow). The chain wheel 34 is provided with teeth 38 which engage in the clearance between plates 35 which are placed side by side.

During the transport of plate link chains, polygon effects or similar erratic motions often occur. In order to exclude or at least minimize such effects, a special tooth shape is chosen, by which the application of force of the cylinder bush 37/roll on the tooth 38 is such that a right angle is formed. Thanks to this measure, multidirectional forces at the point of application 40 are avoided. Thus, only a line-wise contact occurs outside the tooth ground 39 in the point of application 40 between the tooth 38 and the bush 37/roll, such that only a one-directional application of force is realized at the respective point of application.

Analogous to the electric motor 24/reducing gear 26 arranged in the reversing area 23, the other drive units 28, 31, 29, 32 as well as 30, 33 which are provided in the area of the transport path A are positioned between the plate link chains 36.

Figure 6:
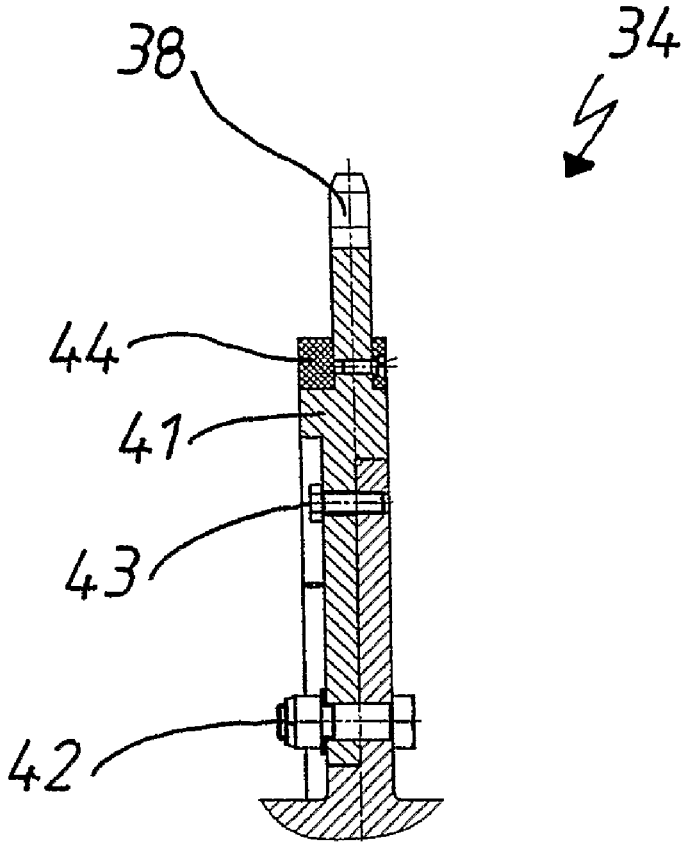
FIG. 6 is a partial representation of the chain wheel according to FIG. 5.

FIG. 6 is a partial representation of a section of the chain wheel 34 according to FIG. 5. Shown is a tooth 38 and a ring which is formed as a separate shoulder 41 in this example and which is detachably connected to the chain wheel base 34' of the chain wheel 34 by screws 42, 43. Herein, the shoulder 41 carries a plastic body 44 on which rests a plate 35 of the plate link chain 36 represented in FIG. 5. This measure permits obtaining a defined distance between the cylinder bush 37/roll and the tooth ground 39 of the chain wheel 34.

The invention has been described in detail with respect to various embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

The invention claimed is:

1. A drive system for an installation for a passenger transport, including an escalator or a moving walkway, having steps or pallets, the drive system comprising:

pulling elements comprised of plate link chains having bushes and rolls adapted to be actively connected to the steps or pallets and moved in a transport direction; and at least one electric motor operatively connected to a gear train having a chain wheel and arranged in a reversing area of the transport and at least one further electric motor interacting with a gear train having a chain wheel including teeth separated by tooth grounds and arranged in a transport path to exclusively serve for a linear motion of the transport, at least some of the electric motors and gear trains in the transport path having approximately the same power, wherein the electric motor containing the gear train and positioned in one of the reversing areas of the transport and the at least one further electric motor exclusively serving for the linear motion of the transport are arranged so that the bushes/rolls of the plate link chains are adjacent to or roll along individual teeth of the chain wheel while only getting into line contact, outside the tooth ground of the chain wheel, and that a point of force application of the cylinder bushes/rolls on the respective tooth of the chain wheel is realized so that only a one-directional force application component is generated at the respective tooth, wherein each chain wheel includes at least one shoulder in the area of its teeth that supports individual plates in a radial direction of the respective plate link chain when the plate link chain runs through the chain wheel.

2. A drive system according to claim 1, wherein the gear train arranged in the reversing area includes chain starwheels which engage with the respective pulling element formed as plate link chains and reverse the plate link chain in the associated reversing area, and the at least one further gear train interacts with chain wheels so that the teeth of the chain wheels engage with the plate link chain to drive the same one in an exclusively linear direction.

3. The drive system according to claim 1, the shoulder is an integral component of the chain wheel.

4. The drive system according to claim 1, wherein the shoulder comprises a separate ring-shaped body which is detachably connected to the chain wheel.

5. The drive system according to claim 1, wherein the shoulder is at least partially made of synthetic material having a pre-determinable Shore hardness.

6. The drive system according to claim 1, wherein the pulling elements include plate link two chains connected to the transport, and the at least one further electric motor includes a gear train positioned between the two plate link chains.

7. A method of driving an excessively long escalator or moving walkway, comprising utilizing the drive system according to claim 1.

8. A method of driving an escalator or moving walkway having a shape of a spatial curve arc, comprising utilizing the drive system according to claim 1.

* * * * *